United States Patent [19]

Nakashima et al.

[11] 3,958,831

[45] May 25, 1976

[54] TUNNEL EXCAVATOR

[75] Inventors: Hachiro Nakashima; Suichiro Miwa; Hiroshi Yanahara; Masakazu Yoshida; Minoru Matsumoto, all of Osaka, Japan

[73] Assignee: Kabushiki Kaisha Komatsu Seisakusho, Tokyo, Japan

[22] Filed: May 28, 1974

[21] Appl. No.: 473,895

[52] U.S. Cl. ..... 299/64; 299/70; 173/43; 173/93

[51] Int. Cl.[2] ..... E21D 9/10; E21C 33/00

[58] Field of Search ..... 299/64–67, 299/69, 70, 94; 173/43, 93

[56] References Cited

UNITED STATES PATENTS

| | | | |
|---|---|---|---|
| 3,346,300 | 10/1967 | Grant | 299/70 |
| 3,586,113 | 6/1971 | Grant | 299/70 |

FOREIGN PATENTS OR APPLICATIONS

| | | | |
|---|---|---|---|
| 686,023 | 12/1962 | Canada | 299/64 |
| 1,172,537 | 12/1969 | United Kingdom | 299/70 |
| 368,527 | 2/1923 | Germany | 299/69 |

*Primary Examiner*—Ernest R. Purser
*Attorney, Agent, or Firm*—Armstrong, Nikaido & Wegner

[57] ABSTRACT

An excavator for excavating a tunnel is provided which has a body provided with gathering and transporting means for the materials excavated by the excavator for discharging the same. The excavator comprises a horizontally and vertically swingable boom mounted on the body and actuated by a cylinder-piston assembly interconnected between the body and the boom. A vertically tiltable excavating cutter is tiltably mounted on the forward end portion of the boom with or without a vertically swingable bracket actuated by a cylinder-piston assembly which is interposed between the cutter and the boom. An impact motor is adapted to intermittently actuating the cutter. An extensible and retractable boom actuated by a cylinder-piston assembly may be interposed between the bracket and the horizontally and vertically swingable boom.

2 Claims, 18 Drawing Figures

TUNNEL EXCAVATOR

BACKGROUND OF THE INVENTION

The present invention relates to a tunnel excavator having a body provided with a horizontally and vertically swingable excavating portion, a gathering portion for gathering materials excavated by the excavating portion, and a transporting portion for transporting the gathered materials rearwardly of the body for discharging the same.

Heretofore, the excavating portion of a conventional excavator of the type described above comprises a rotating cutter. When the condition of the ground to be excavated varies, the only measure for accommodating the variation in the condition of the ground is to interchange the cutter with one having a different configuration and/or different material. Therefore, when a firmly conglomerated ground including solid pebbles or a rock bed having a compressive strength greater than 1000 kg/cm$^2$ is to be excavated, cemented carbide tips at the forward end of the cutter tends to be broken or detached from the cutter thereby shortening the life of the cutter, while greatly reducing the efficiency of excavation. In other words, it is hardly possible to excavate the firmly conglomerated ground including pebbles or a rock bed having the compressive strength greater than 1000 kg/cm$^2$ by using a rotating cutter heretofore used in the excavation.

The present invention aims at avoiding the above described disadvantages of the prior art excavator.

SUMMARY OF THE INVENTION

It is an object of the present invention to provide a novel and useful tunnel excavator which avoids the disadvantages of the prior art excavator described above.

Another object is to provide a novel and useful excavator of the type described above which makes it possible to efficiently excavate a firmly conglomerated group including pebbles or a rock bed having the compressive strength greater than 1000 kg/cm$^2$.

The above objects are achieved in accordance with the present invention by providing an excavator of a tunnel having a body provided with a gathering device for materials excavated by the excavator and a transporting device for transporting the materials gathered by the gathering device rearwardly of the excavator for discharging the same. The excavator is characterized by a horizontally and vertically swingable boom mounted on the body, a cylinder-piston assembly arranged between the body and the boom for horizontally and vertically swinging the same, a vertically tiltable excavating cutter having a sharp tip at its forward end portion and tiltably mounted on the forward end portion of the boom, and an impact motor arranged between the cutter and the boom for intermittently applying impact force to cutter.

By the construction as described above, the cutter actuated by the impact motor can efficiently excavate relatively soft ground by keeping the cutter clear of hard pebbles during the operation of the excavator.

In accordance with another feature of the present invention, the cutter may be mounted on a swingable bracket which in turn mounted on the forward end portion of the boom and actuated by a cylinder-piston assembly interconnected between the bracket and the boom so that the excavating force of the cutter is increased by the action of the cylinder-piston assembly actuating the bracket thereby further improving the efficiency of the excavation.

In accordance with a still further feature of the present invention, an extensible and retractable boom may be interposed between the swingable bracket and the horizontally and vertically swingable boom. The extensible and retractable boom is actuated by a cylinder-piston assembly so as to be extended or retracted with respect to the swingable boom thereby enlarging the working area of the cutter.

DETAILED DESCRIPTION OF THE PREFERRED EMBODIMENTS

Figure 1:
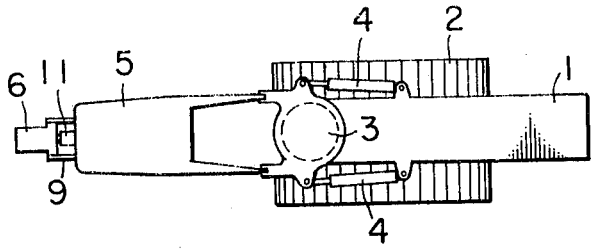
FIG. 1 is a general plan view showing a first embodiment of the excavator constructed in accordance with the present invention.
Figure 2:
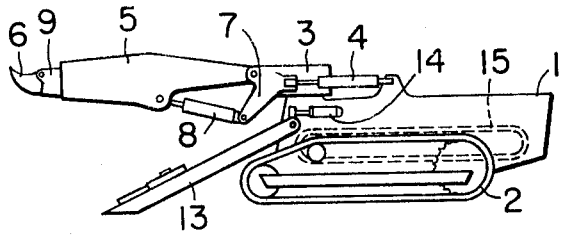
FIG. 2 is a general side view of FIG. 1.
Figure 3:
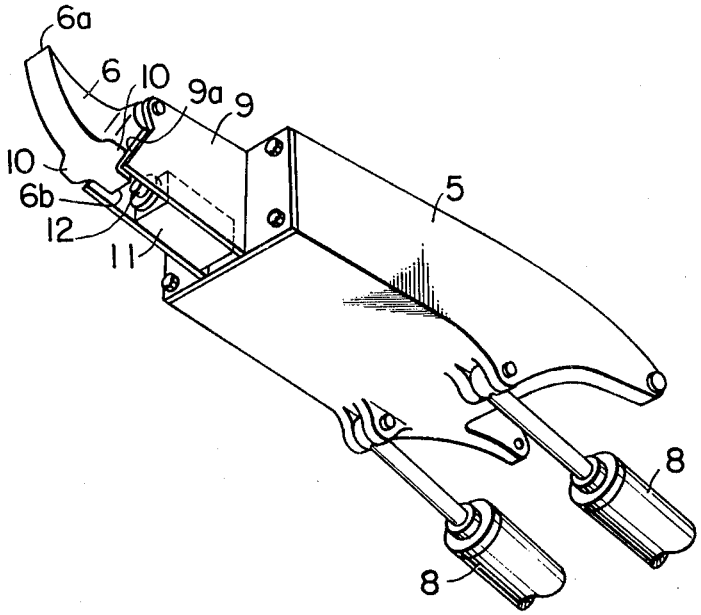
FIG. 3 is a fragmentary perspective view showing in detail the arrangement of the cutter and the boom of FIG. 1.

Referring to FIGS. 1 – 3 showing the first embodiment of the present invention, the body 1 of the excavator is provided with a pair of endless caterpillars 2 each located at the respective side of the body 1 for the self-propelling of the excavator.

A swingable member 3 is mounted on the upper side of the body 1 by means of bearings (not shown) so as to be swung about a vertical axis.

A pair of cylinder-piston assemblies 4 are connected between the swingable member 3 and the body 1 at either sides thereof and actuated by control means (not shown) so that the swingable member 3 is rotated about the vertical axis to any desired direction.

The one end of a vertically swingable boom 5 is rotatably mounted on the forward end of the swingable member 3 by a pivot shaft so as to be swung vertically.

In order to control the vertical position of the boom 5, a pair of cylinder-piston assemblies 8 are connected between the mid-portion of the boom 5 and the tip of arms 7 which extend obliquely downward from the swingable member 3. The assemblies actuated by control means (not shown).

Thus, the boom 5 can be swung in vertical and horizontal directions so as to be oriented in any desired direction by the actuation of the cylinder-piston assemblies 4 and 8.

A vertically tiltable excavating cutter 6 has a sharp working edge 6a and is pivotally mounted by a pivot shaft on the forward end portion of a bracket 9 which is in turn fixedly secured to the forward end of the boom 5.

The cutter 6 is provided with a raised ridge 10 in each side thereof which is adapted to abut against each of the forward end edges **9*a* of the bracket 9 so as to limit the anticlockwise rotation of the cutter 6 as seen in FIGS. 2 and 3 thereby bearing the reactional force given by the cutter 6** during the operation thereof.

In accordance with the characteristic feature of the present invention, an impact motor 11 having an actuator 12 is located in the bracket 9 which is intermittently actuated by control means (not shown) so that the actuator 12 of the impact motor 11 applies impact forces to the rear face **6*b* of the cutter 6 so as to assist the excavating action of the cutter 6**.

When the actuator 12 is in its retracted position, however, the tip of the actuator 12 is held apart from the rear face **6*b* of the cutter 6 as the ridges 10 abut against the forward end edges 9*a* of the bracket 9**.

The excavator is provided with a gathering device 13 pivotally mounted at its rear end on the forward end of the body 1.

A cylinder-piston assembly 14 is connected between the one arm of the gathering device 13 and the body 1 at each side thereof so that the device 13 can be swung upwardly and downwardly by the operation of the cylinder-piston assembly 14. The gathering device 13 serves to collect thereon materials excavated by the cutter 6.

A conveyor 15 is arranged in the body 1 which receives and transports the materials collected on the gathering device 13 rearwardly of the body 1 to discharge it from the excavator.

Figure 4:
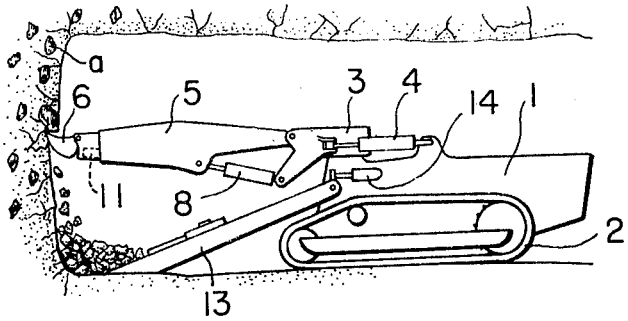
FIG. 4 is a side view showing the manner of operation of the excavator of FIG. 1.
Figure 5:
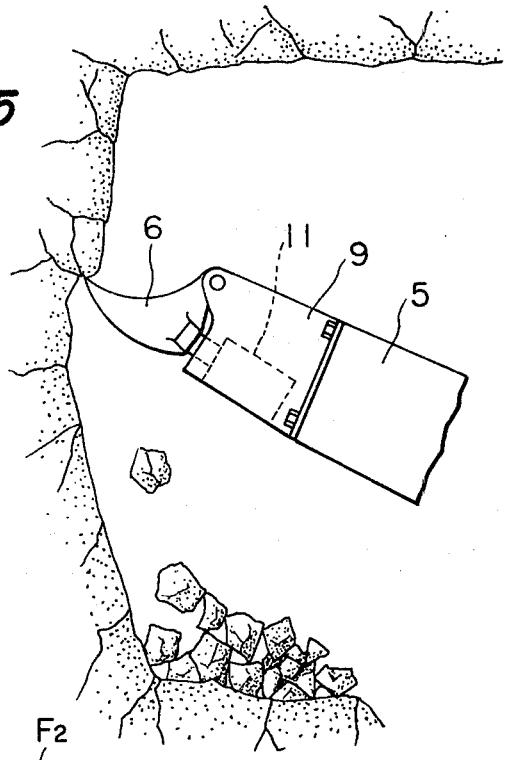
FIG. 5 is a fragmentary side view showing in detail the operation of the cutter driven by the impact motor therefore.

When the excavator is operated for excavating firmly settled earth in which a relatively soft soil is studded with pebbles, the boom 5 is swung upwardly and downwardly by the actuation of the cylinder-piston assemblies 8 after the boom 5 has been directed to a desired horizontal direction by the rotation of the swingable member 3, so that the cutter 6 excavates the soil in such a manner that the cutter 6 is advanced clear of the pebbles in the soil thereby permitting the pebbles a to be removed from the earth as shown in FIG. 4.

When the excavator is operated for excavating a rock bed having the compressive strength greater than 1000 kg/cm$^2$, the impact motor 11 is driven while the boom 5 is swung upwardly and downwardly so as to drive the cutter 6. Thus impact forces are applied to the cutter 6 during the excavating operation thereof.

Figure 6:
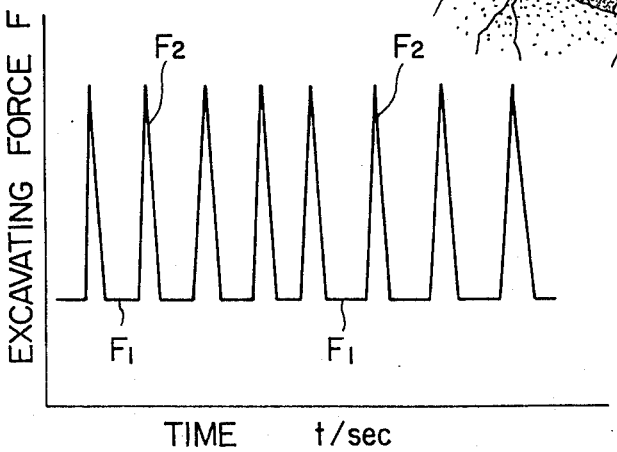
FIG. 6 is a diagram showing the variation in the excavating force in relation to the time.

Thus, the excavating force of the cutter 6 resulting from the impact forces $F_2$ applied by the impact motor 11 and the driving force $F_1$ applied by the movement of the boom 5 can be represented as the curve given in FIG. 6. Therefore, even an extremely solid or firm rock bed having the compressive strength greater than 1000 kg/cm$^2$ can be excavated. Since the actuator 12 of the impact motor 11 is held apart from the rear face **6*b* of the cutter 6 when the actuator 12 is retracted, the reactional force of the cutter 6 is born by the bracket 9 by virtue of the abutment of the ridges 10 of the cutter 6 against the forward end edges 9*a* of the bracket 9 thereby avoiding harmful action to the impact motor 11**.

The construction as described above affords advantages as follows:

1. The materials excavated by the cutter 6 are gathered by the gathering device 13 controlled by the cylinder-piston assemblies 14 and the gathered materials are transported rearwardly of the body 1 by means of the conveyor 15 thereby insuring the efficient excavating operation of the excavator.

2. The cutter 6 is provided with the sharp working edge **6*a* and the cutter 6 can be moved upward and downward as well as left and right by the cylinder-piston assemblies 8,4 thereby permitting the relatively soft soil to be selectively excavated by the cutter 6** without striking pebbles. Therefore, an efficient excavating operation is insured without the danger of excessive wear or damage to the cutter.

3. Since the impact forces are applied intermittently by the impact motor 11 to the cutter 6, the excavating force is the sum of the driving force $F_1$ of the boom 5 actuated by the cylinder-piston assembly 8 and the impact forces $F_2$ of the impact motor 11, thereby permitting even an extremely firm rock bed having a compressive strength greater than 1000 kg/cm$^2$ to be efficiently excavated.

FIGS. 7 to 11 show the second embodiment of the present invention. This embodiment is substantially similar to that shown in FIGS. 1 – 3 except that the bracket 9 is swingably mounted on the forward end of the boom 5 instead of being fixedly secured to the boom 5 as shown in FIGS. 2 and 3 and a pair of cylinder-piston assemblies 16 are arranged between the bracket 9 and the boom 5 so as to swing the bracket 9 upward and downward by the actuation of the cylinder-piston assemblies 16.

Figure 7:
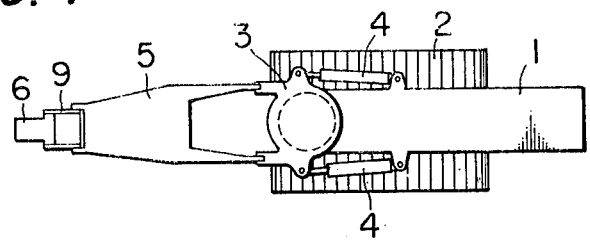
FIG. 7 is a general plan view similar to FIG. 1 but showing a second embodiment of the present invention.
Figure 8:
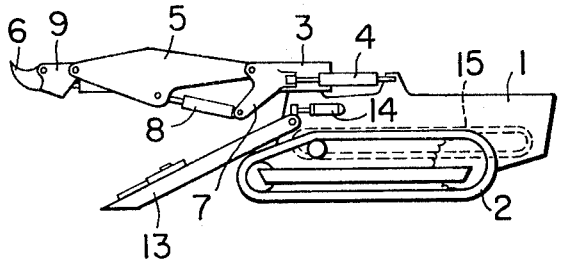
FIG. 8 is a general side view showing the excavator of FIG. 7.
Figure 9:
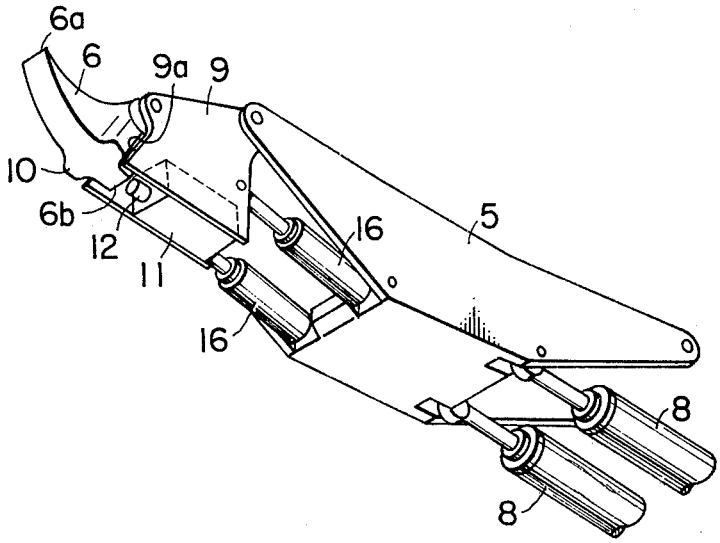
FIG. 9 is a fragmentary perspective view showing the arrangement of the cutter, the swingable bracket and the boom of FIG. 7.
Figure 10:
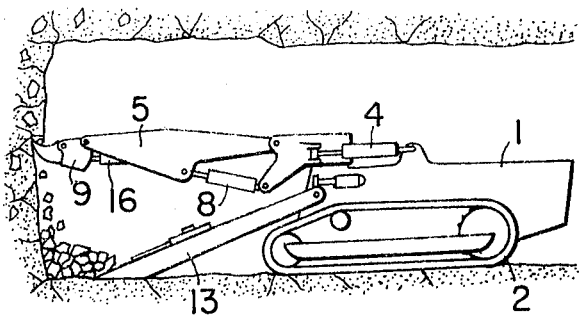
FIG. 10 is a side view showing the manner of operation of the excavator of FIG. 7.
Figure 11:
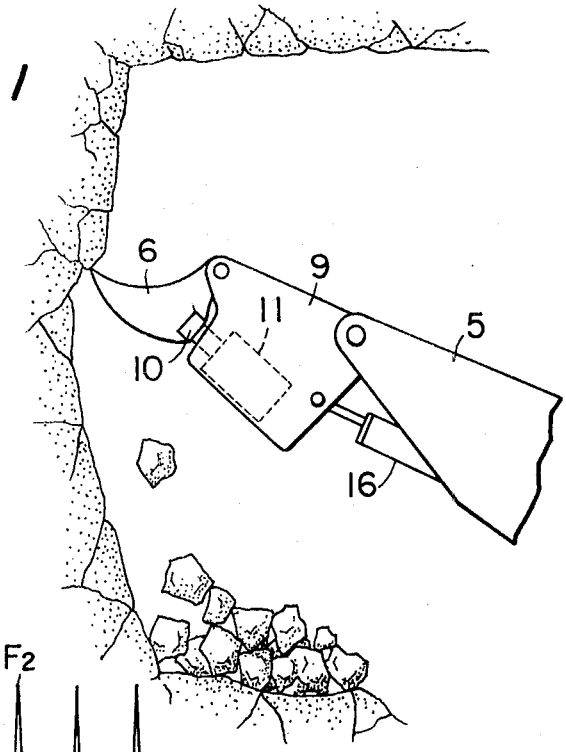
FIG. 11 is a fragmentary side view showing in detail the manner of operation of the cutter and the swingable bracket of FIG. 7.

In operation, the cylinder-piston assemblies 16 are also actuated so as to apply an additional driving force $F_3$ to the cutter 6 as shown in FIGS. 10 and 11 in addition to the driving force $F_1$ given by the actuation of the boom 5 and the impact forces $F_2$ shown in FIG. 6. Thus, the excavating force of the cutter 6 can be represented by the curve given in FIG. 12. As is clear from the curve of FIG. 12, the excavating force of the cutter 6 of the embodiment shown in FIGS. 7 – 9 is far greater than that given by the embodiment of FIGS. 1 – 3 thereby insuring a further increased efficiency of the operation of the excavator.

Since the inclination of the cutter 6 can be optionally adjusted by the actuation of the cylinder-piston assemblies 16, the cutter 6 can be accommodated to the particular condition of the facing of the tunnel so as to achieve most efficient excavating operation.

FIGS. 13 – 16 show the third embodiment of the present invention. This embodiment is substantially similar to that shown in FIGS. 7 – 9 except that an extensible and retractable boom 17 is slidably mounted in the forward end portion of the boom 5 and a pair of cylinder-piston assemblies 18 are connected between the extensible and retractable boom 17 and the boom 5 so as to shift the former forward and rearward with respect to the latter by the actuation of the cylinder-piston assemblies 18. The bracket 9 is pivotally mounted on the forward end of the boom 17 instead of being mounted on the boom 5 while the cylinder-piston assemblies 16 are connected between the bracket 9 and the boom 17, thereby permitting the cutter 6 to be moved forward and rearward with respect to the boom 5 so that the working area of the cutter 6 is increased.

Figure 15:
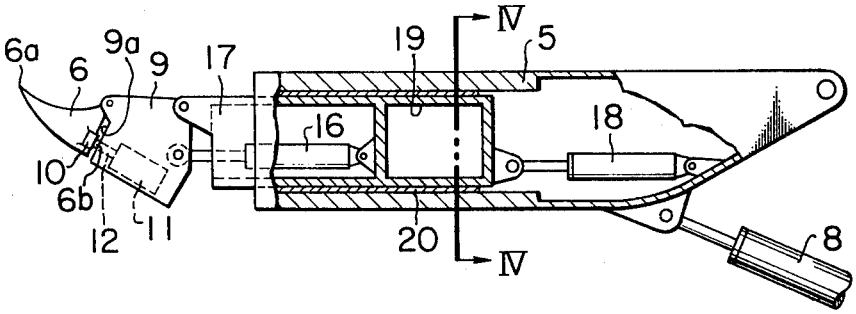
FIG. 15 is a fragmentary side view partly in section showing the internal construction of the extensible and retractable boom mounted in the swingable boom of FIG. 13.
Figure 16:
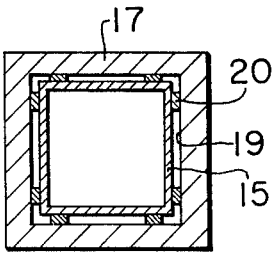
FIG. 16 is a cross-sectional view showing the sliding guide means of the extensible and retractable boom of FIG. 15.

As shown in FIGS. 15 and 16, the boom 17 and the boom 5 are of rectangular form in cross-section and the boom 17 is slidingly guided within the boom 5 by means of sliding pieces 20 slidingly contacting with rails 19 formed on the inner surface of the boom 5.

Figure 17:
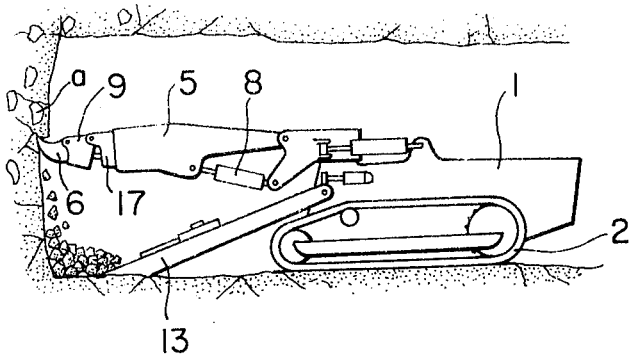
FIG. 17 is a general side view showing the manner of operation of the excavator of FIG. 13.
Figure 18:
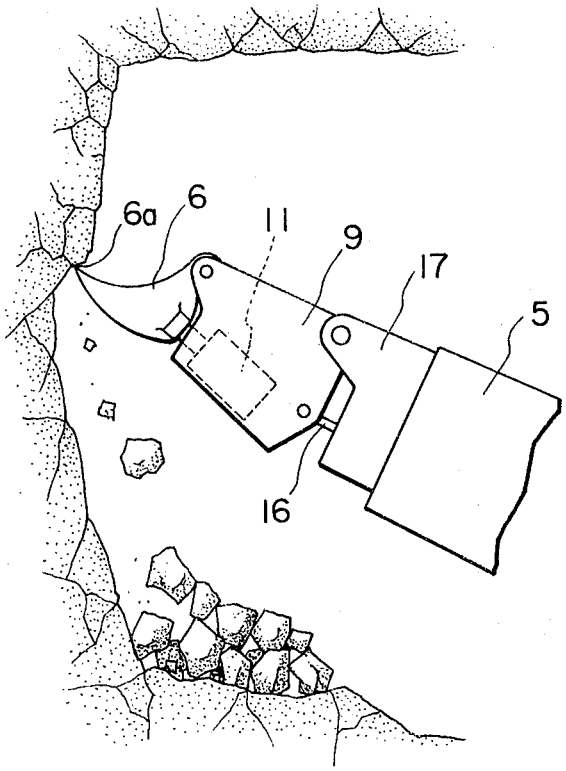
FIG. 18 is a fragmentary side view showing in detail the operation of the cutter, the bracket and the extensible and retractable boom of FIG. 15.

As shown in FIGS. 17 and 18, the boom 17 is extended as the excavating operation advances so that the working area is increased without requiring the advance of the body 1.

Figure 12:
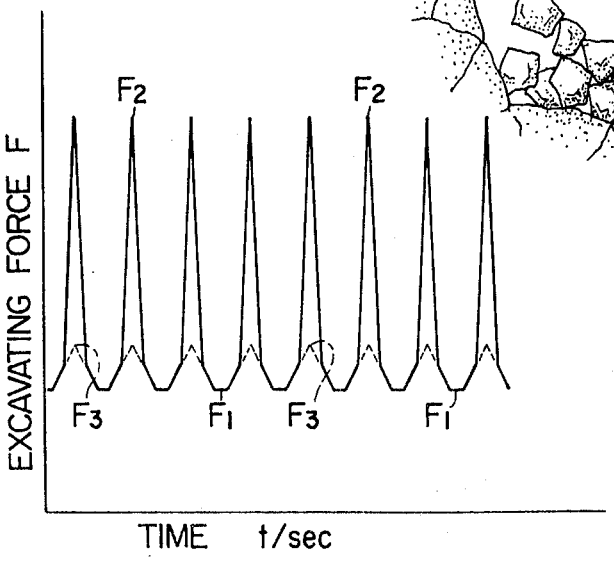
FIG. 12 is a diagram showing the variation in excavating force in relation to the time.
Figure 13:
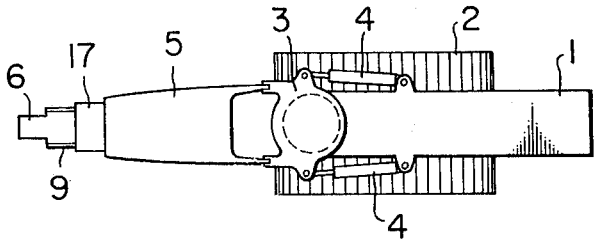
FIG. 13 is a general plan view similar to FIG. 1 but showing a third embodiment of the present invention.
Figure 14:
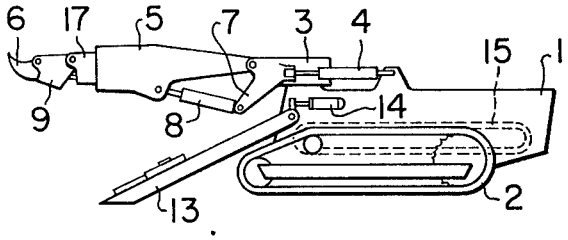
FIG. 14 is a general side view of FIG. 13.

The excavating forces given to the cutter 6 is similar to that of the embodiment of FIGS. 7 – 9 as shown in FIG. 12.

We claim:

1. An excavator, for excavating a tunnel, comprising a body; a horizontally and vertically swingable boom mounted on said body; a first cylinder-piston assembly means arranged between said body and said boom for horizontally and vertically swinging said boom; a swingable bracket pivotally mounted on the forward end portion of said boom; a second cylinder-piston assembly means arranged between said bracket and said boom for swinging said bracket with respect to said boom; a vertically tiltable excavating cutter having a sharp tip at its forward end portion pivotally mounted on said bracket such that said bracket is forced upward and downward by said second cylinder-piston assembly means arranged between said bracket and said boom while said boom is held stationary; and power operator impact means arranged between said cutter and said bracket for intermittently applying an impact force to said cutter; raised ridge means formed on each side of said cutter opposite the side edges of said bracket for bearing the excavating reactional force applied to said cutter during excavation; a gathering means for gathering materials excavated by said excavator, and a transporting means for transporting the materials gathered by said gathering mean to the rear of said excavator discharging said materials.

2. An excavator according to claim 1 wherein said impact means comprises an impact motor and an activator fixedly located in the bracket, said activator being projected by the action of said impact motor on the rear face thereof.

* * * * *